United States Patent [19]

Morin et al.

[11] Patent Number: 4,478,399

[45] Date of Patent: Oct. 23, 1984

[54] INSERTING SYSTEM FOR NEWSPAPERS

[76] Inventors: George A. Morin, P.O. Box 826, Aurora, Colo. 80010; Raymond H. Richardson, 66 Waverly Ave., Claredon Hills, Ill. 60514

[21] Appl. No.: 399,011

[22] Filed: Jul. 16, 1982

Related U.S. Application Data

[63] Continuation of Ser. No. 185,236, Sep. 8, 1980, abandoned.

[51] Int. Cl.[3] ..... B65H 5/30

[52] U.S. Cl. ..... 270/55; 270/57

[58] Field of Search ..... 270/54–58; 271/96, 94, 101, 35

[56] References Cited

U.S. PATENT DOCUMENTS

| | | | |
|---|---|---|---|
| 2,849,232 | 8/1958 | Halahan | 271/101 X |
| 2,905,309 | 9/1959 | Makrides | 271/96 X |
| 3,212,772 | 10/1965 | Ward | 271/35 X |
| 3,312,464 | 4/1967 | Rehm | 271/96 |
| 3,620,526 | 11/1971 | Iles | 271/96 |
| 3,627,302 | 12/1971 | Dutro | 270/55 |
| 3,664,660 | 5/1972 | Runzi | 270/35 |

OTHER PUBLICATIONS

Xerox Disclosure Journal; vol. #4, No. 5, Sep./Oct. 1979; "Low Force Feeder", S. Bains.

*Primary Examiner*—A. J. Heinz

[57] ABSTRACT

An inserter is provided for placing an insert into newspaper jackets as the jackets are fed at printing press speed. The inserts are fed from a hopper by a perforated endless continuously moving belt by means of selectively activating vacuum and air pressure plenums located on the side of the belt opposite the inserts in the hopper. In one embodiment, the flow of air pressure of a vacuum to a plenum is controlled by a valve and in a second embodiment, the perforations and slots in the belt serve as the valve means. The apparatus of this invention provides rapid acceleration of inserts selectively without the necessity of overcoming the inertia of mechanical holding and feeding devices.

12 Claims, 19 Drawing Figures

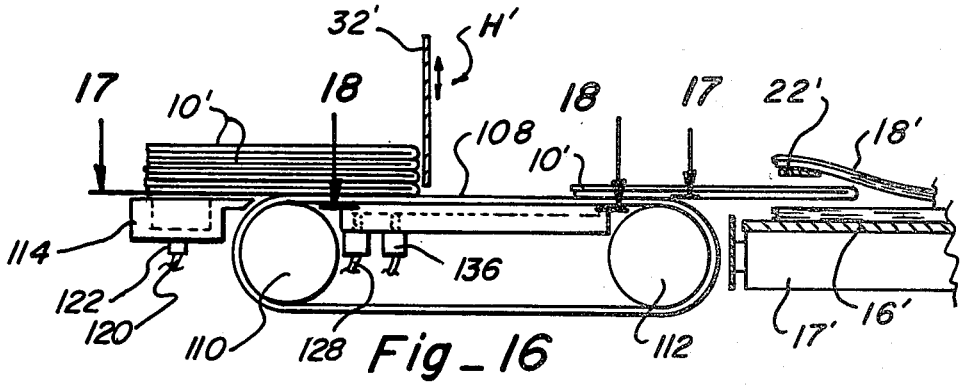
Fig_16
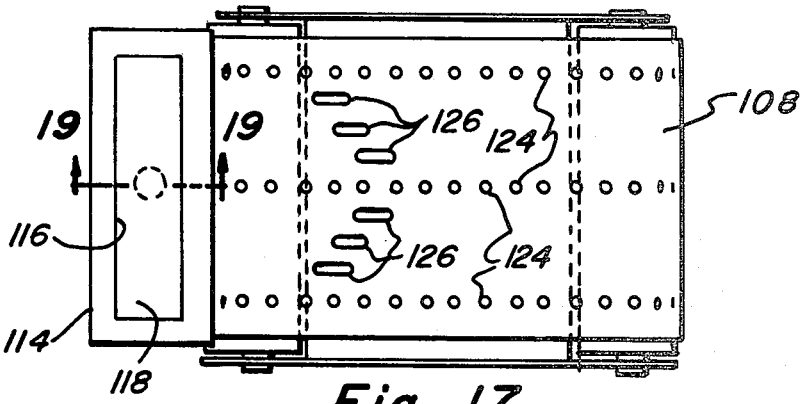
Fig_17
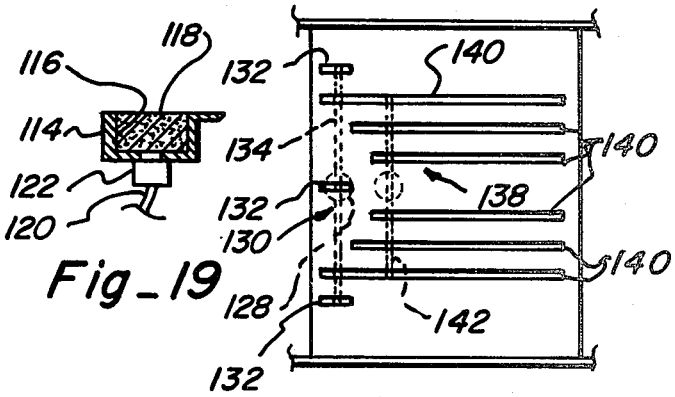
Fig_19
Fig_18

INSERTING SYSTEM FOR NEWSPAPERS

This is a continuation of U.S. application Ser. No. 185,236, filed Sept. 8, 1980, now abandoned.

DESCRIPTION

Technical Field

This invention relates to a device for placing inserts in newspapers and more particularly, to such a system for placing the inserts in the newspapers when the newspapers are moving at printing press speed. This is accomplished by providing a system which does not rely on mechanical gating operations for sequentially feeding the inserts into the newspapers.

Background Art

It is common practice for newspaper publishers to provide advertisers with the service of placing advertising within their newspapers for distribution along with those newspapers. This method of distributing advertising is used extensively, especially in large metropolitan areas. It is attractive to both the newspaper publishers and the advertisers in that it provides the newspapers with additional revenue and the advertiser with a very economical means of distributing the advertising material to their potential customers.

One difficulty with inserters is that they are unable to keep up with high speed printing presses. In other words, the time required to place the insert in the newspaper is too long to be practical unless the publisher is preparing a Sunday supplement wherein the supplement is prepared a number of days ahead and the inserts can be placed in the supplement over a period of several days. On the other hand, insertion into daily papers, where the number of papers distributed each day may be a million or more, is impractical. Thus, the use of inserts has been limited. One of the reasons for the slowness in inserting is that the inserting machines have had mechanical gates for sequentially dispensing the inserts from the bottom of a hopper. Because of the inertia inherent in a mechanical gate, the time in cycling the gate is so slow that inserts cannot be placed in newspapers at a sufficiently rapid rate to be practical for most applications. An example of one mechanical inserter is shown in U.S. Pat. No. 908,469 to La Sor.

Various belt feeding devices in which elements are sequentially fed from the bottom of a hopper have included slotted endless belts with suction boxes wherein suction can be selectively applied to the bottommost element in the hopper for feeding it. However, these have been complex in operation and have not been practical for placing inserts in newspapers. An example of such a feeding apparatus is shown in U.S. Pat. No. 3,941,372 to Matsuo which is a device for feeding corrugated cardboard sheets from the bottom of a stack. However, in addition to the suction boxes, the whole belt mechanism is arranged to tilt to move the device from a feeding mode to a non-feeding mode thereby incorporating a mechanical system having the inertial drawbacks referred to above.

Disclosure of Invention

In accordance with this invention, an apparatus for feeding inserts into newspaper jackets is provided having means for holding a supply of inserts for movement along a supply path for sequential feeding. An endless perforated belt runs between the supply path and a discharge point at or adjacent a jacket conveyer and has an air plenum means located on a side of the belt opposite the supply holding means. The belt runs at an appropriate speed for transmitting an insert from the supply holding means to an open jacket in proper sequence as jackets for receiving the inserts are fed at high speed along a separate conveyor. The stack of inserts are held off of the endless belt by means of a positive airflow through the air plenum and through the holes in the belt. By an appropriate sensing means which senses the movement of the newspaper jackets, the airflow from the plenum means is stopped and may be reversed so as to pull the closest insert against the conveyer where it is quickly accelerated to the speed of the conveyer and fed into the jacket, whereupon the positive airflow is again introduced used through the plenum to hold the remaining inserts from contact with the endless belt until the next jacket is in position.

More particularly, in one embodiment, the present invention relates to an insert feeding apparatus having a hopper in which inserts are stacked above a continuously moving belt conveyer passing beneath the forward portion of the lowest insert in the hopper and moving in a direction to sequentially withdraw the inserts from the hopper and insert them in a newspaper jacket. In one embodiment, the conveyer belt is perforated and passes over two plenums, one of which is a pressure plenum positioned beneath the upper surface of the belt totally within the area of the hopper and the other is a vacuum or hold-down plenum positioned beneath the downstream end of the hopper and having a portion which extends downstream from the hopper past the gate to a point upstream of the jacket conveyer. A third or restraining plenum is positioned beneath the bottom insert in the hopper at a position upstream from the continuous conveyer and adjacent the pressure plenum. The wall of the hopper at the point where the conveyer exits from the hopper has a gate brush which acts as a restraint holding the inserts within the hopper. The plenums have slits whose geometry is established to provide rapid acceleration of the inserts from the hopper by the conveyer belt and downstream to a discharge point where each insert is fed into a newspaper jacket.

In operation, a vacuum is drawn through the restraining plenum in the hopper which holds the bottom insert in position within the hopper. Air pressure is provided to the switching plenum lifting the bottom insert in the hopper off of the surface of the continuous moving conveyer belt. When it is desired to feed an insert, the vacuum to the restraining plenum is discontinued, the positive pressure to the pressure plenum may be discontinued and a vacuum is applied to the hold-down plenum which draws the lowest insert down against the moving belt which quickly accelerates the insert, moving it from the hopper beneath the gate brush and to the discharge point where it is fed into a jacket. The jacket may be opened by mechanical means or by a series of air jets so that the insert can be put in place. The gate brush restrains the remaining inserts above from leaving the hopper. As the lower insert clears the hopper gate, the vacuum pressure is reinstituted to the restraining plenum to hold a new bottom insert in position and pressure at the pressure plenum lifts the downstream end of the new bottom insert from the conveyer belt.

Positioning and timing sensers are used to control the valving of the plenums in order to control the spacing between the inserts as they are withdrawn from the hopper and to feed the inserts in accordance with the movement of the jackets.

In another embodiment, a pressure plenum comprising a series of short channels located under the hopper provides positive air pressure to hold the leading edge of the lowermost insert off of the belt. A vacuum plenum comprises a series of interconnected long channels downstream of the hopper having upstream ends extending under the hopper and at least some of them being interlaid with the short channels. The belt has longitudinal rows of perforations aligned with the respective short channels and longitudinal slots which are aligned with said long channels, wherein the perforations and slots act as valves to control air flow through the channels and hence the movement of the inserts. Furthermore, a restraining plenum located under the hopper and upstream of the belt may be provided which includes a transverse recess filled with an open cell material to create an even air flow due to vacuum selectively applied thereto to hold the inserts within the hopper. As can be seen, this invention avoids the necessity of mechanical gating means which are slow in operation, but rather relies merely on switching air flow through the perforated conveyer belt which belt runs at continuous speed and at a speed sufficient to feed the inserts as rapidly as needed. Additional advantages of this invention will become apparent when taken in conjunction with the accompanying drawings.

Brief Description of Drawings

FIG. 16 is a vertical section of a second embodiment wherein the hopper and conveyer belt are mounted in a horizontal position;

FIG. 17 is a horizontal section, taken along line 17—17 of FIG. 16, showing a conveyer belt having perforations and slots which serve as the valving means for the pneumatic system for selectively and sequentially feeding the inserts from the bottom of the hopper;

FIG. 18 is a horizontal section, taken along line 18—18 of FIG. 16, showing channels which comprise a pressure plenum and a vacuum plenum by cooperating with the slots in the endless belt to provide the desired valving sequence; and FIG. 19 is a vertical section, taken along line 19—19 of FIG. 17, showing further details of the hold-down plenum of FIGS. 16 and 17.

Description of Preferred Embodiments

Figure 1:
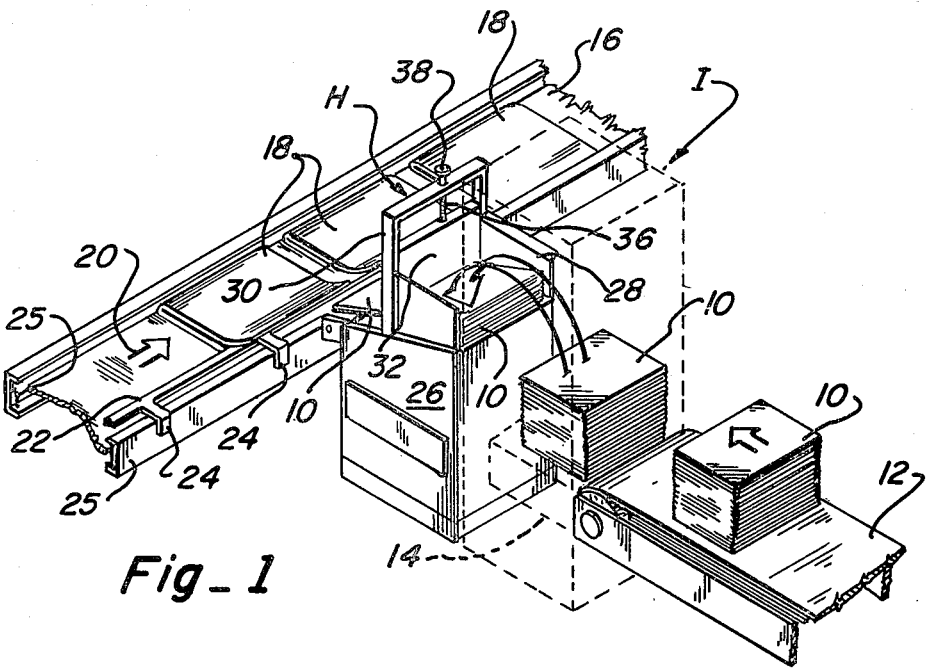
FIG. 1 is a perspective view of one form of the inserter of this invention.
Figure 2:
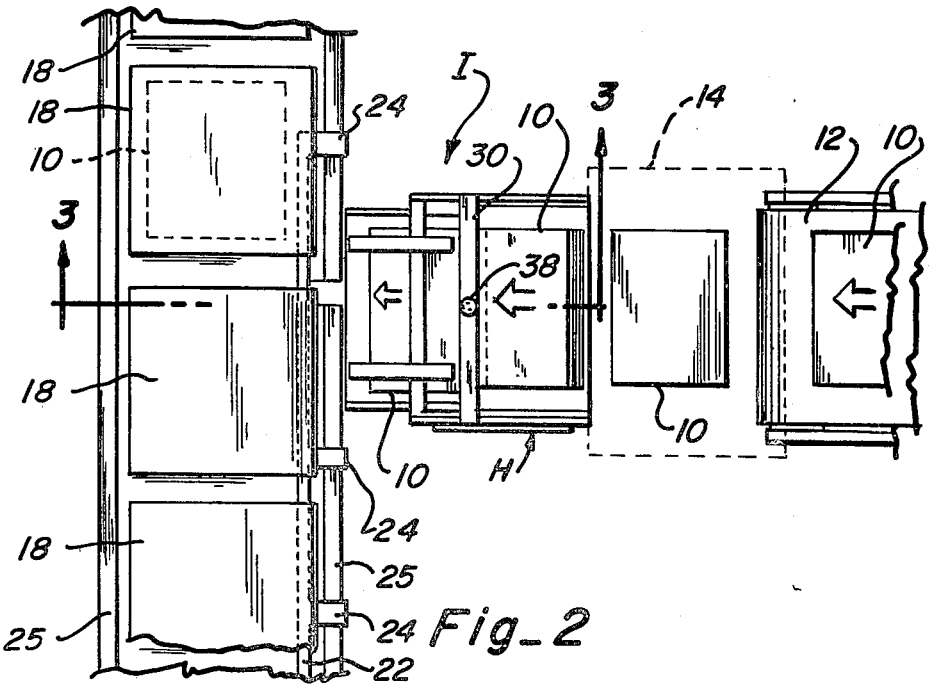
FIG. 2 is a top plan view of the inserter of FIG. 1.

In accordance with this invention, in one embodiment an inserter I is provided, as best seen in FIGS. 1 and 2, wherein stacked inserts 10 are fed along a supply conveyer 12 to a loading station 14, shown in dotted lines, from which the inserts may be placed manually or by suitable mechanical mechanism into hopper H. A newspaper jacket conveyer 16 runs transversely to the inserter. It is supported by spaced rollers, such as roller 17, seen in FIG. 3, and sequentially carries newspaper jackets 18 past the inserter in the direction of arrow 20. The jackets of the newspaper are separated by a bar 22 which is supported by spaced brackets 24 attached to conveyer rail 25. The inserts are sequentially fed along a supply path from hopper H, in a manner to be described, and in synchronism with the movement of newspaper jackets 18 along conveyer 16 so that an insert is fed between brackets 24 and into an open newspaper jacket 18 of each newspaper jacket as it passes inserter I.

Figures 3, 4, 5:
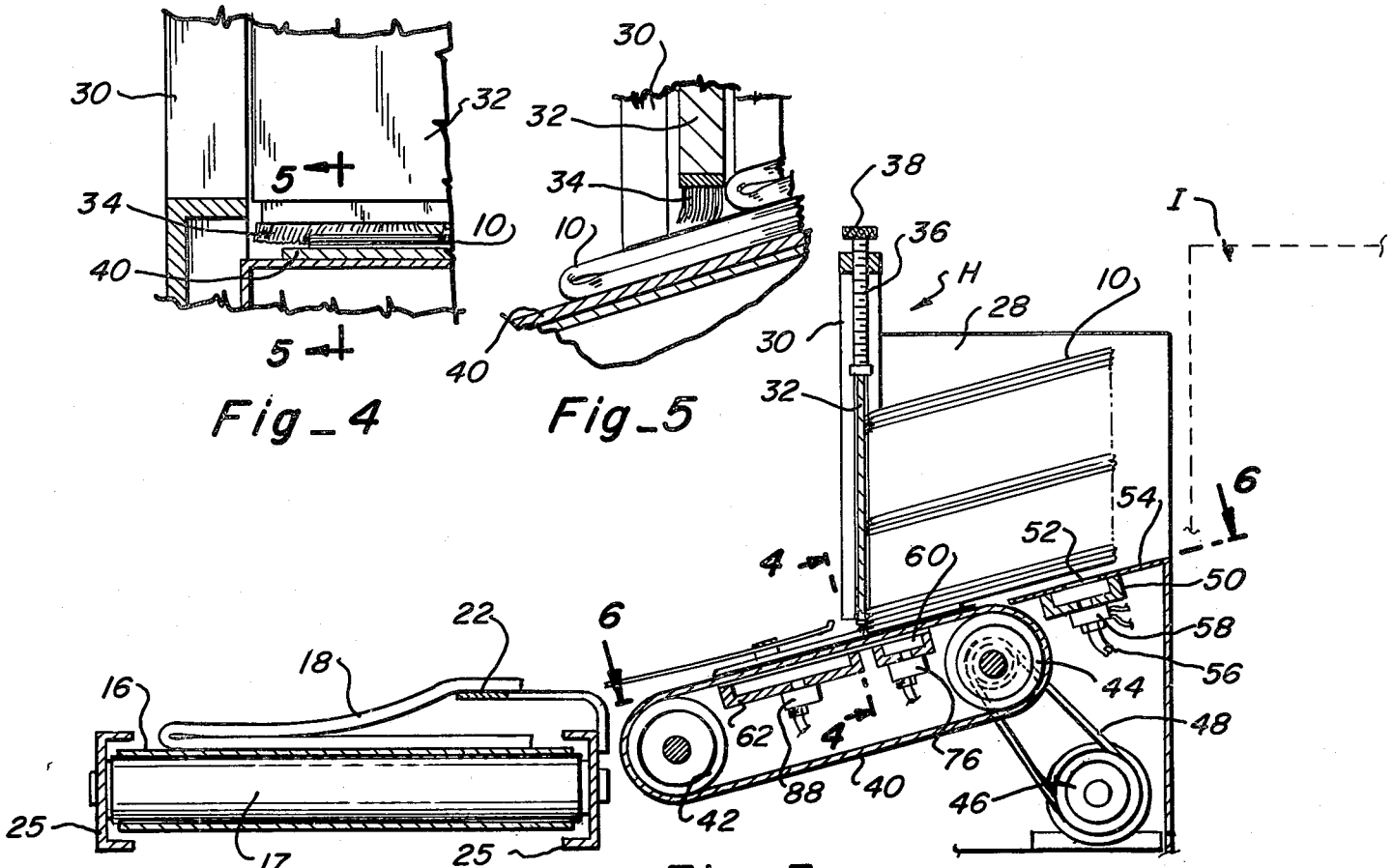
FIG. 3 is an enlarged vertical section of the inserter, taken along line 3—3 of FIG. 2 showing an insert being fed from the hopper toward a newspaper jacket.
FIG. 4 is a greatly enlarged vertical section, taken along line 4—4 of FIG. 3, showing the gating mechanism for the hopper containing the inserts.
FIG. 5 is a very greatly enlarged vertical section taken along line 5—5 of FIG. 4 showing further details of the gating mechanism.

As best seen in FIGS. 1-3, hopper H has opposed side walls 26 and 28 interconnected at their downstream edge by a generally U-shaped frame 30 in which a gate 32 is slideably mounted. Advantageously, the bottom of the gate is provided with a brush 34 and the height of the gate can be adjusted by threaded post 36 which extends through a tapped hole in the center of bracket 30 and has an adjustment knob 38 attached to the outer end thereof, as shown. Thus, the height of the gate can be adjusted upwardly or downwardly depending on the thickness of the particular insert to be dispensed.

Turning to FIG. 3, an endless belt 40 extends from the forward end of hopper 10 underneath the bottom insert past the gate and to a point adjacent newspaper conveyer 16 and is supported by spaced rollers 42 and 44 as shown. Conveniently, the belt may be driven by any conventional power source, such as electric motor 46 through belt 48. Thus, the belt can feed the lowermost insert past brush 34 of gate 32 and into the opened newspaper jacket 18.

Figure 6:
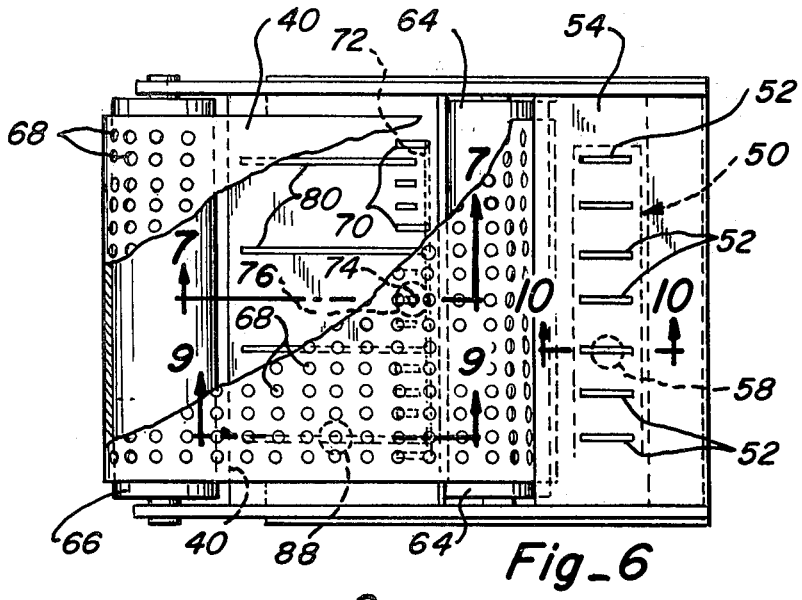
FIG. 6 is a longitudinal section taken along lines 6—6 of FIG. 3 showing the perforated conveyer belt and plenum arrangement thereunder.
Figure 10:
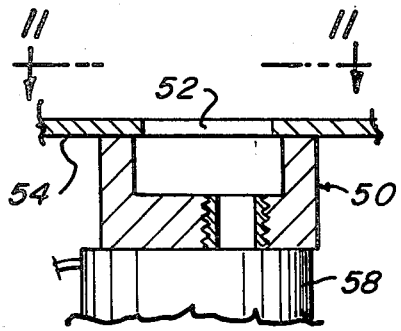
FIG. 10 is an enlarged horizontal section, taken along 10—10 of FIG. 6, showing details of the holding plenum.
Figure 11:
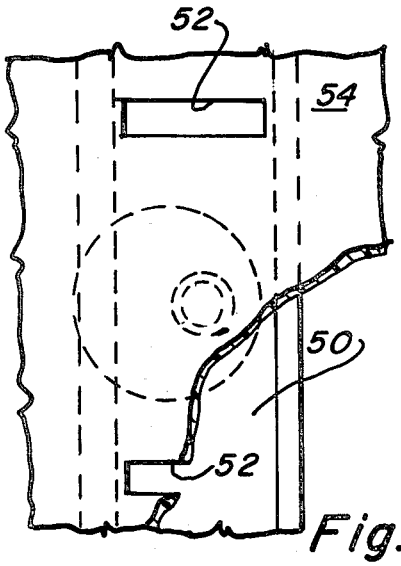
FIG. 11 is a horizontal view, taken along line 11—11 of FIG. 10, showing further details of the holding plenum, with parts broken away for clarity of illstration.

In order to sequentially cycle the inserts onto the belt 40 for feeding into the jackets, a plurality of air plenums are provided. At the bottom of the hopper and upstream from belt 40, a restraining plenum 50 extends transversely of the hopper as best seen in FIGS. 6, 10, and 11. A plurality of longitudinal slots 52 are provided in the bottom wall 54 of hopper H, as best shown in FIG. 6, to provide communication between the hopper and the plenum. Conveniently, plenum 50 is connected to a vacuum hose 56 through a solenoid valve 58. Thus, when solenoid 58 is opened connecting vacuum 56 to plenum 50, the lower insert 10 in the hopper will be held tightly against the bottom 54 of the hopper so that it cannot be fed by endless belt 40 past gate 32. However, when the solenoid valve is closed so that the vacuum to plenum 50 is cut off, then the lowermost insert can be drawn forwardly past gate 32 by belt 40 in a manner to be described.

Conveniently, under the upper run of endless belt 40 is a switching plenum 60 located below the forward end of hopper H and holding plenum 62 extends from the forward end of the hopper downstream toward the discharge point at the newspaper conveyer. Belt 40 is provided with a plurality of laterally spaced longitudinally extending rows of perforations 68, the upper run extending over switching plenum 60 and holding plenum 62.

Figure 7:
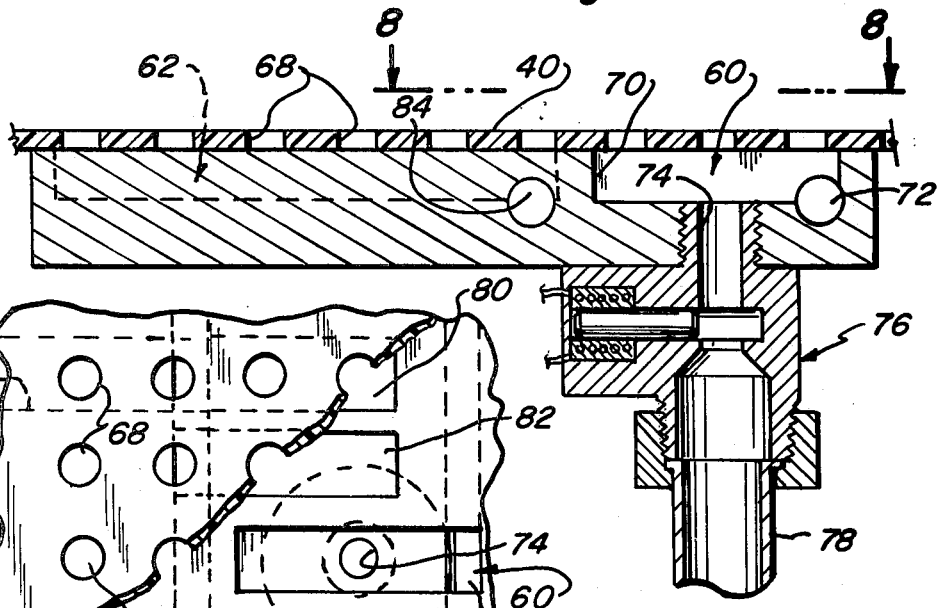
FIG. 7 is an enlarged horizontal section, taken along line 7-7 of FIG. 6, showing details of the switching plenum.
Figure 8:
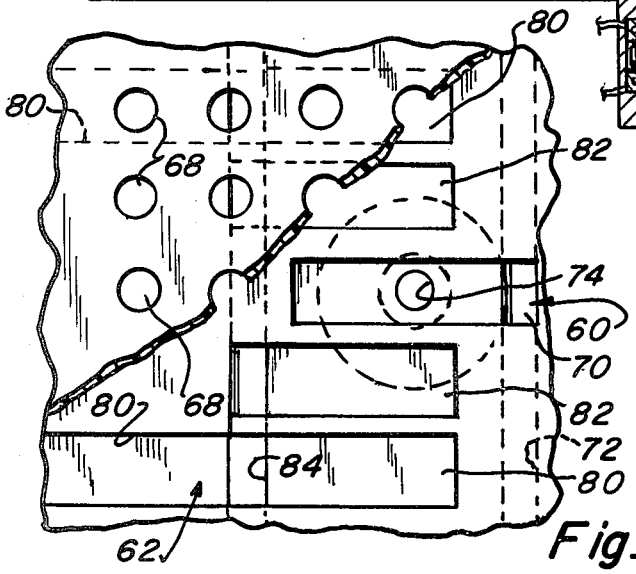
FIG. 8 is a fragmentary horizontal view, taken along line 8—8 of FIG. 7, showing further details of the switching plenum and belt, with parts broken away for clarity of illustration.
Figure 13:
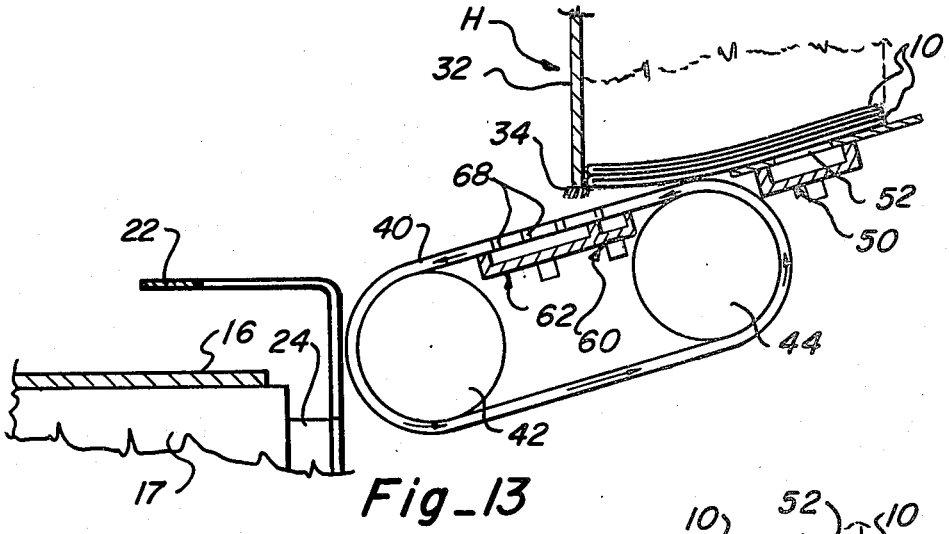
FIG. 13 is a vertical section, similar to FIG. 3, showing the position of the inserts prior to feeding.
Figure 14:
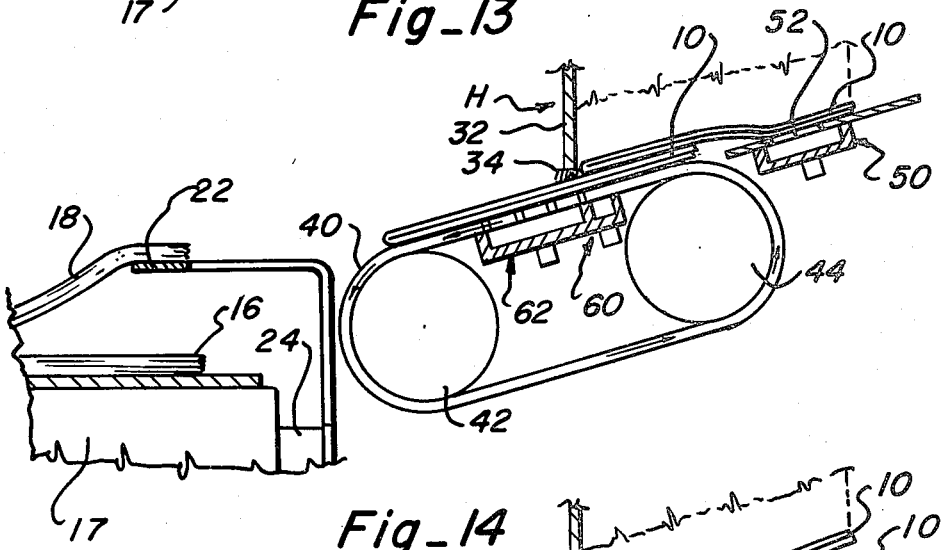
FIG. 14 is a vertical section, similar to FIG. 13, but showing an insert being fed through the gate of the hopper.

As best seen in FIGS. 6–8, switching plenum 60 comprises a plurality of longitudinally extending, relatively short channels 70 interconnected by a transverse passageway 72. Advantageously, one of channels 70, such as the centermost channel, is provided with an inlet 74 connected through a solenoid valve 76 which selectively provides air pressure through perforations 68 in the belt to hold the leading edge of the lowermost insert off of the belt so that it is not fed under gate 32. The pressure is provided through a supply line 78 connected to valve 76, as shown in FIG. 7. As previously pointed out, plenum 60 is positioned under the hopper and just below the leading edge of inserts 10 positioned therein. Thus, when solenoid valve 76 is opened, the air pressure will pass through channel 70 and perforations 68 in the belt to hold the leading edge of the lowermost insert 10 off of the belt while at the same time vacuum applied to restraining plenum 50 will hold the upstream end of the inserts so that they cannot be fed onto the belt, as best illustrated in FIG. 13.

When it is desired to feed an insert, the vacuum is removed from plenum 50 and the air pressure is removed from pressure plenum 60. At the same time, vacuum is applied to vacuum plenum 62 to draw the insert through the gate accelerating it to the speed of the belt to feed it into a newspaper jacket 18.

Figure 9:
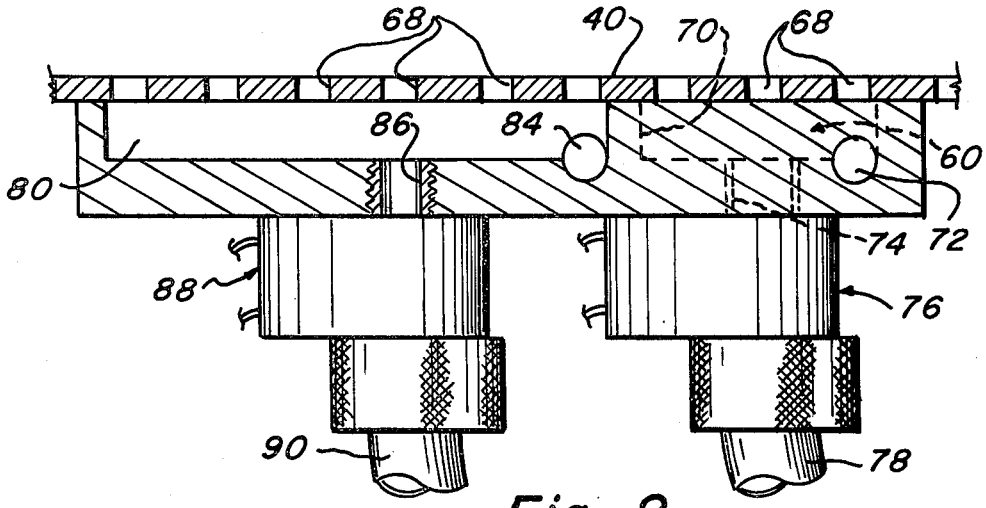
FIG. 9 is an enlarged horizontal section, taken along line 9—9 of FIG. 6, showing details of the restraining plenum.

Referring again to FIGS. 6–8, vacuum plenum 62 comprises a first series of relatively long longitudinally extending channels 80 which are laterally spaced from each other and whose upstream ends are interleaved with short channels 70. In addition, plenum 62 includes a second set of short channels 82 whose upstream ends are aligned with channels 80 and are interlaid therewith and with short channels 70. The downstream end of short channels 82 terminates in a transverse passageway 84 which joins short channels 82 with long channels 80. An outlet 86 is provided in one of the long channels 80 and is connected through a solenoid valve 88 to a vacuum line 90, as best seen in FIG. 9.

Figure 12:
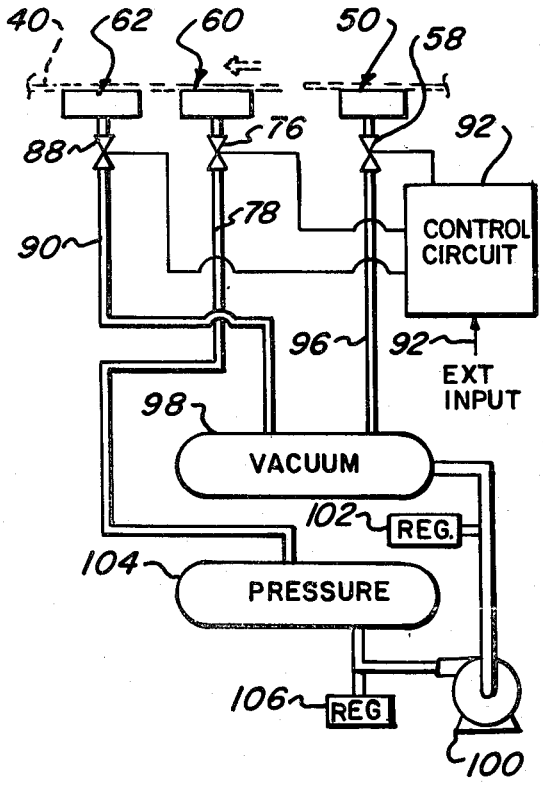
FIG. 12 is a diagramatic view of the pneumatic system for use with the inserter of this invention.
Figure 15:
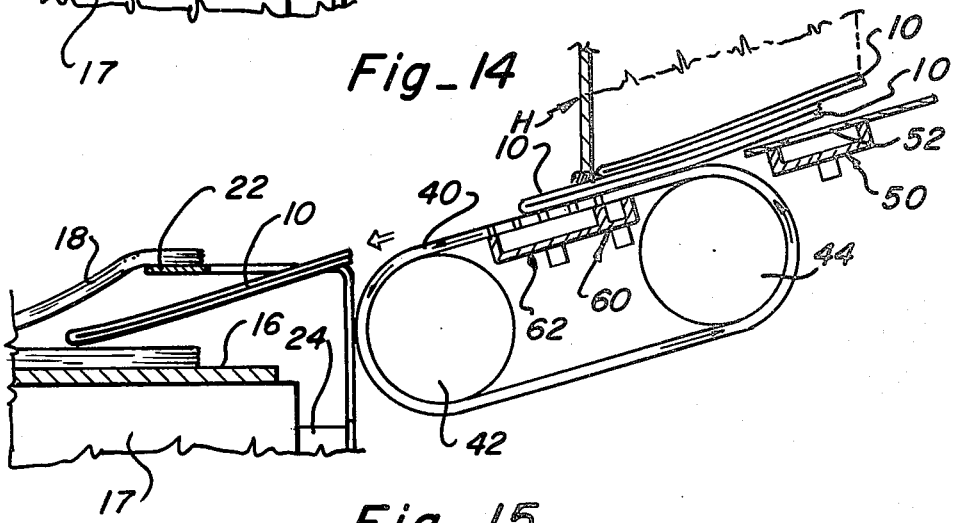
FIG. 15 is a vertical section similar to FIGS. 13 and 14 but showing the first insert being fed into an open newspaper jacket and a second insert being fed through the hopper gate.

When it is desired to feed an insert, vacuum to manifold 50 is discontinued and vacuum is applied to manifold 62. Alternatively, the air pressure to manifold 60 can either continue uninterrupted or can be shut off. If it continues uninterrupted, the vacuum pressure to manifold 62 must be great enough to overcome the positive air pressure from slot 70 and since there are more vacuum slots 80 and 82, the apparatus can easily be designed to accomplish this. In any event, by the application of vacuum thorugh manifold 62, the leading edge of the lowermost insert 10 is pulled down against the belt and since it is no longer held by manifold 50, is accelerated by the belt and passes under brush 34 on the bottom of gate 32 as shown in FIG. 5 until it is moved to a discharge point where it is fed into open newspaper jacket 18 as best seen in FIG. 15. A control system for cycling the feeding of the inserts is shown in FIG. 12. The respective valves 58, 76 and 88 are operated by a control circuit 92 which has an external input 94 to provide a signal to the control circuit indicating when an insert should be fed from hopper H so as to reach the position of an open newspaper jacket 18 at the appropriate time. It will be apparent to one skilled in the art that such an external input can be initiated by sensing the position of the newspaper jackets as they move along conveyer 16. A vacuum line 96 is connected to valve 58 for drawing a vacuum on plenum 50 and has an opposite end connected to a vacuum tank 98 on which a vacuum is drawn by compressor motor 100. Also, vacuum line 90 is connected to vacuum tank 98, as shown. Conveniently, a first regulator 102 is provided to control the vacuum pressure. Pressure line 78 to manifold 60 is connected to pressure tank 104 and is supplied pressure by compressor motor 100, the pressure being controlled by a second regulator 106.

An alternative second embodiment is shown in FIGS. 16–19 wherein inserts 10′ are fed from a vertical hopper H′ having a vertically adjustable gate 32′ as shown. The inserts are sequentially fed by means of an endless belt I08 which is supported between an upstream roller 110 and a downstream roller 112. As in the previous embodiment, the inserts 10′ are fed into newspaper jackets 18′ traveling along newspaper conveyer 16′ supported by spaced rollers, such as roller 17′. The jackets are opened by a separating bar 22′. A restraining plenum 114 is provided upstream of the belt and under hopper H′. The restraining plenum has a transverse recess 116 filled with an open cell material 118 to permit an even vacuum to be drawn across plenum 114 by a vacuum hose 120 connected to the plenum by a solenoid valve 122. When vacuum is applied, the inserts 10′ will be held against the plenum and will not be fed by belt 108 under gate 32′.

In this embodiment, the valve control for feeding the inserts is provided by use of appropriately placed perforations and slots in belt 108. In this regard, the belt, as viewed in FIG. 17, has three longitudinal rows of perforations 124 with staggered valve slots 126 therebetween. Conveniently, an air pressure hose 128 is connected to an air pressure platen 130 which comprises three longitudinally extending relatively short channels 132 whose spacing corresponds with the spacing of perforations 124. Channels 132 are interconnected by a passageway 134 which in turn is connected to pressure hose 128. Thus, air supplied by pressure hose 128 will pass through passageway 134 to channels 132 and through the perforations 124 in belt 108 normally causing the forward end of inserts 10′ to raise so that they are not fed by belt 108 under gate 32′.

Vacuum hose 136 is connected to vacuum platen 138 which comprises a plurality of relatively long channels 140 whose upstream ends are staggered in the same relationship as slots 126. The channels are interconnected by a passageway 142. Thus, when slots 126 come in alignment with the upstream end of channels 140, a vacuum will be applied to the bottom of the lowermost insert 10' and because of the enlarged area for vacuum contact, the forward end of the lowermost insert 10' will be pulled down against the belt and against the pressure exerted by pressure manifold 130. When the insert comes into frictional contact with belt 108 it will be accelerated to the speed of the belt and pass through gate 32' to be inserted into a newspaper jacket 18' as in the previous embodiment. Thus, with this embodiment, it is not necessary to continually open and close valves to cycle the operation with the exception of the valve 122 for restraining platen 114 which must be closed when valve slots 126 come into alignment with channels 140 so that the lowermost insert can be moved by the belt.

From the foregoing, the advantages of this invention are readily apparent. An apparatus has been provided in a first embodiment for feeding inserts into newspaper jackets at printing press speed since the use of mechanical gates is not necessary, thereby overcoming the speed limitations inherent in mechanical feeding devices. This is accomplished in one embodiment by holding inserts in place in a hopper by means of a restraining plenum which applies a vacuum to the lowermost insert while a belt moves continuously under the forward end of the inserts. The forward end of the insert is held off of the belt by means of a pressure platen providing a positive air force which raises the forward edge of the lowermost insert above the gate of the hopper and off of the surface of the belt. When it is desired to feed an insert, the air supply to the pressure platen is turned off and a vacuum is turned on to a vacuum platen having channels which interlay with channels on the pressure platen to pull the forwardmost end of the insert down against the belt whereupon vacuum on the restraining platen is removed and the insert is accelerated by the belt and fed to a discharge point where it is received within the jacket of a newspaper which has been opened by a separating bar or other suitable means.

In a second embodiment, the valving of the platens is accomplished by the use of staggered slots in the belt which sequentially come into registration with vacuum channels on the vacuum platen for overcoming air pressure from the pressure platen to pull the insert down against the belt and accelerate it to the speed of the belt so that it is fed into a newspaper jacket.

It will be understood that even though the embodiments which have been described provide for feeding the inserts from a hopper above the endless belt, it is contemplated that inserts could be fed from a supply means below an endless belt. The platens would then be located above the belt.

The invention has been described in detail with particular reference to preferred embodiments thereof, but it will be understood that variations and modifications can be effected within the spirit and scope of the invention.

We claim:

1. An apparatus for feeding printed inserts sequentially into newspaper jackets as the jackets are fed along a predetermined path at high speed from an upstream location to a downstream location, said apparatus comprising:

a hopper at said upstream location for supplying said inserts and having a preadjusted, stationary gate providing an opening of a size through which the inserts sequentially may be fed only one at a time;

a high speed continuously movable endless perforated conveyor belt extending from within said hopper at said upstream location past said gate to a discharge point at said downstream location to selectively move inserts from said hopper and to said discharge point and into the newspaper jackets;

a pressure plenum mounted on a side of said belt opposite said hopper and just upstream of and immediately adjacent to said gate and having openings in communication with a first portion of said belt perforations;

means for supplying air under pressure to said pressure plenum to cause air to be blown through said first portion of belt perforations to hold the leading edge of the closest insert off of said belt at said gate to prevent feeding of the inserts;

a vacuum plenum mounted downstream of said pressure plenum and said gate and having openings in communication with said first portion of belt perforations and with a second portion of said belt perforations downstream of said gate;

means for drawing a vacuum through said vacuum plenum to cause air drawn through said first and second portion of belt perforations to pull the leading edge of the closest insert against said belt to accelerate it to the speed of said belt and move it through said gate to said discharge point and into a newspaper jacket;

a plurality of first relatively short longitudinally extending channels spaced laterally below said belt and located entirely below said hopper;

means supplying air pressure to said first channels;

a longitudinal row of perforations in said belt each having an open area aligned to pass over each of said first channels, respectively;

a plurality of second relatively long longitudinally extending channels spaced laterally below said belt and extending from a point below said hopper to a point downstream of said hopper;

means drawing a vacuum through each of said second channels; and said belt perforations comprising a plurality of longitudinal valve slots in said belt aligned to pass over each of said second channels respectively for selectively applying a vacuum to the lowermost insert in said hopper each time said valve slots respectively pass over said second channels, said slots each having a length proportional to the time required to feed an insert and said slots each being spaced from each other in accordance with the desired feed rate of successive inserts.

2. An apparatus, as claimed in claim 1, wherein:

a portion of said second channels extend upstream a sufficient distance to be interlaid with said first channels.

3. An apparatus, as claimed in claim 2, wherein:

said upstream portions of said second channels are staggered so as to form longitudinally spaced upstream ends with respect to each other.

4. An apparatus, as claimed in claim 3, wherein:

said valve slots are staggered so as to have the same respective longitudinal spacing as said upstream ends of said second channels.

5. An apparatus, as claimed in claim 4, wherein:

said belt has a side edge and a center line; and the upstream ends of said second channels and said valve slots are longitudinally spaced further downstream as they progress from said side edge of said belt toward said center line.

6. An apparatus, as claimed in claim 1, wherein:

said valve slots have an open area under said hopper which is greater than the area of said perforations so that when said valve slots pass under said hopper the vacuum drawn through them is sufficient to overcome the air pressure through said perforations so that the lowermost insert is pulled down onto said belt and fed through said gate by said belt.

7. An apparatus, as claimed in claim 1, further including:

a restraining plenum extending transversely under said hopper upstream of said belt and said first channels for selectively holding the lowermost insert so that it is not fed under said gate;

a source of vacuum connected to said restraining plenum; and open cell material in said restraining plenum through which the vacuum can be drawn evenly across said plenum.

8. An apparatus for feeding printed inserts sequentially into newspaper jackets as the jackets are fed along a predetermined path at high speed from an upstream location to a downstream location, said apparatus comprising:

a hopper at said upstream location for supplying said inserts and having a preadjusted, stationary gate providing an opening of a size through which the inserts sequentially may be fed only one at a time;

a high speed continuously movable endless perforated conveyor belt extending from within said hopper at said upstream location past said gate to a discharge point at said downstream location to selectively move inserts from said hopper to said discharge point and into the newspaper jackets;

a pressure plenum mounted on a side of said belt opposite said hopper and just upstream of and immediately adjacent to said gate and having openings in communication with a first portion of said belt perforations;

means for supplying air under pressure to said pressure platen, including a valve for controlling the flow of air to said pressure plenum, to cause air to be blown through said first portion of belt perforations to hold the leading edge of the closest insert off of said belt at said gate to prevent feeding of the inserts;

a vacuum plenum mounted downstream of said pressure plenum and said gate and having openings in communication with said first portion of belt perforations and with a second portion of said belt perforations downstream of said gate;

means for drawing a vacuum through said vacuum plenum, including a valve for controlling the flow of air through said vacuum plenum, to cause air drawn through said first and second portion of belt perforations to pull the leading edge of the closest insert against said belt to accelerate it to the speed of said belt and move it through said gate to said discharge point and into a newspaper jacket;

a control circuit for controlling said pressure plenum valve and said air plenum valve to regulate the flow of air through said first portion of belt perforations to intermitently and selectively bring an insert in said hopper into contact with said belt so that the insert is accelerated to the speed of said belt to feed the inserts into the jackets;

an external input connected to said control circuit; and means to provide a signal to said control circuit to selectively regulate said pressure plenum valve and said vacuum plenum valve in response to movement of each of the jackets along said predetermined path so that the air pressure from said pressure plenum is sufficiently greater than the vacuum through said first portion of belt perforations when no feeding is desired and wherein the vacuum through said first portion of belt perforations is greater than the pressure from said pressure platen when an insert is to be fed.

9. An apparatus, as claimed in claim 8, wherein said perforations are arranged in rows extending longitudinally on said belt, said pressure plenum including:

a plurality of longitudinally extending pressure plenum channels spaced laterally across said belt, each channel being aligned with only one of said rows of perforations;

a first fluid passageway extending transversely across said channels placing them in fluid communication with each other; and a first solenoid valve means is connected to one of said channels for selectively controlling flow of air through said pressure plenum in response to the position and movement of newspaper jackets to receive the inserts.

10. An apparatus, as claimed in claim 9, wherein said vacuum plenum includes:

a first plurality of relatively long channels spaced laterally across said belt, each long channel being aligned with only one of selected ones of said rows and having first ends extending upstream under said gate and being interlaid with said pressure platen channels and having second ends extending downstream and terminating adjacent said discharge point;

a second plurality of relatively short channels spaced laterally across said belt, each short channel being aligned with other selected ones of said rows and having first ends extending upstream under said gate and being interlaid between said pressure plenum channels and said first ends of said long channels and having second ends downstream of said gate;

a second fluid passageway extending transversely across said second ends of said short channels and through said long channels and in fluid communication with said short and long channels; and a second solenoid valve means is connected to said second fluid passageway for selectively controlling vacuum drawn through said short and long channels of said vacuum plenum in response to the position and movement of newspaper jackets to receive the inserts.

11. An apparatus, as claimed in claim 10, further including:

a restraining plenum in said supply path and located upstream of said endless belt and opposite said hopper; and means for drawing a vacuum through said restraining plenum to hold the closest insert against said restraining plenum so that it cannot be fed by said belt.

12. An apparatus, as claimed in claim 11, wherein said vacuum drawing means comprises a third valve means, said apparatus further including:

control means connected to said first, second and third valve means responsive to movement of the newspaper jackets to rapidly cycle the feeding of the inserts from said supply path so that an insert is fed into a jacket each time a jacket passes said discharge point.

* * * * *